United States Patent [19]

Carter et al.

[11] 4,432,819

[45] Feb. 21, 1984

[54] PRIMING COMPOSITION AND TECHNIQUES

[75] Inventors: George B. Carter, Lichfield; Alan Cross, Rubery, both of England

[73] Assignee: Imperial Metal Industries (Kynoch) Limited, Birmingham, England

[21] Appl. No.: 722,072

[22] Filed: Sep. 3, 1976

[30] Foreign Application Priority Data

Sep. 11, 1975 [GB] United Kingdom ..... 37386/75

[51] Int. Cl.[3] ..... C06B 31/00

[52] U.S. Cl. ..... 149/45; 149/60; 264/3 R; 102/202; 102/204

[58] Field of Search ..... 149/45, 60; 264/3 R; 102/202, 204

[56] References Cited

U.S. PATENT DOCUMENTS

| | | | |
|---|---|---|---|
| 2,116,878 | 5/1938 | Brun et al. | 149/45 X |
| 2,160,469 | 5/1939 | Brun et al. | 149/45 X |
| 2,173,270 | 9/1939 | Burrows | 149/45 X |
| 2,175,826 | 10/1939 | Brun | 149/45 X |
| 2,239,547 | 4/1941 | Brun | 149/45 X |
| 2,327,867 | 8/1943 | Calhoun | 149/45 X |
| 4,247,494 | 1/1981 | Carter | 149/24 |

*Primary Examiner*—Stephen J. Lechert, Jr.

*Attorney, Agent, or Firm*—Cushman, Darby & Cushman

[57] ABSTRACT

A priming composition for an explosive device using a double salt of hypophosphite, especially lead nitrato-hypophosphite.

11 Claims, No Drawings

PRIMING COMPOSITION AND TECHNIQUES

BACKGROUND OF THE INVENTION

The present invention relates to explosives for priming explosive devices, for example ammunition cartridges and detonators.

Conventional priming composition for small arms cartridges comprises lead styphnate, and for detonators comprises lead azide or a mixture of lead azide and lead styphnate, as the primary explosive. German Patent Specification 289016 suggests the double salt lead nitrato-hypophosphite as a primary explosive. That patent issued in 1922, but there does not appear to have been any practical use of the double salt until Brun and Burns suggested its use as a relatively minor ingredient in a priming composition described in U.S. Pat. No. 2,116,878. The double salt was to be produced by a technique as described in U.S. Pat. No. 2,160,469. However, that specification indicates that lead nitrato-hypophosphite is not a satisfactory substitute for azide or styphnate because of its inability to ignite secondary explosives.

The present inventors have found that double salts of hypophosphites can be substituted for azides and styphnates as primary explosives. The present invention therefore provides a priming (or initiating) composition whereof the primary explosive is wholly or mostly constituted by a "multiple" salt of a hypophosphite. In the present specification the term "multiple" salt is used to indicate a salt produced by co-crystallisation of two or more component salts. The invention also provides a method of initiating a secondary explosive comprising the step of exploding such a priming composition.

The composition may include other, preferably non-explosive, ingredients, for example a frictionator and/or a fuel. The multiple salt preferably comprises a nitrate component and a hypophosphite component. Preferably both components are lead salts.

SUMMARY OF THE INVENTION

According to one aspect of the invention, there is provided the combination of a priming composition as defined above with a nitrocellulose-based propellant. The propellant may be in the form of discs, for example as supplied by Imperial Chemical Industries Limited under the name "Acurex". The propellant may, however, alternatively be in the form of ball, flake or military powders.

According to a further aspect of the invention, there is provided the combination of a priming composition as defined above with a secondary charge of a detonator. This may be a base charge, for example tetryl or PETN.

According to a further aspect of the invention, there is provided a method of producing a priming composition as defined above, comprising bringing together components of the multiple salt in a liquid medium to form the multiple salt. A relatively soluble component may be added in solution to a relatively insoluble component, for example lead nitrate solution may be added to lead hypophosphite, preferably in the form of powder. Alternatively, the components may be mixed in the form of powders, and the liquid medium may be added to the mixed powders. The medium is preferably water. The multiple salt may be formed at ambient temperature.

Lead nitrato-hypophosphite may be prepared by bringing together lead nitrate and lead hypophosphite in an aqueous medium. The preparation may be effected at ambient temperature, and will provide a product in the form of needle-like crystals. The lead nitrate and lead hypophosphite are preferably in substantially equal weight proportions.

The multiple salt may be formed in a mixture which includes one or more other ingredients of the composition, for example a frictionator and/or a fuel. In co-pending U.S. applications claiming priority from British Patent Application No. 37385/75 filed Sept. 11, 1975 in the name of Imperial Metal Industries (Kynoch) Limited and citing as inventors Richard Northan Knights, Peter Howard Whittall, Gordon Roy Sutcliffe and John Francis Hobbs, there is described a process for producing priming explosive using three features singly or in combination. The three features are:

1. said explosive is produced in a relatively small quantity, preferably appropriate to an individual utilisation demand,
2. said explosive is produced at a relatively low output rate, preferably not substantially greater than the rate at which it is used in priming,
3. production of said explosive is substantially continuous, or simultaneous, with its further utilisation.

According to the preferred form of that process (a) the components used in production of the explosive are relatively insensitive, preferably non-explosive, (b) explosive is produced in situ in a utilising device.

In the present specification, the terms "utilising device" and "production in situ" have the following meanings:-

Utilising device—refers to a combination of at least two elements, at least one of which is a body of explosive. The other element may be a mere container or carrier for the explosive, such as a rimfire cartridge case, a detonator case or a cap shell. The device may be only partially finished, for example (a) further elements may have to be added to it for final use such as propellant and a bullet for a rimfire cartridge, or an electric match or a fuse for a detonator; (b) the elements may have to be reshaped, or relocated relative to each other as when priming composition in a rimfire cartridge case is forced into the rim of the case by a conventional spinning punch after explosive has formed in the head of the case.

Production in situ—means that the explosive is produced in relation to at least one other element so as to provide said combination. Where the other element is a container, the explosive will normally be produced within it. If the other element were a carrier, the explosive could be produced as a body around a portion of the carrier. As indicated above, producing in situ does not imply that the combination is immediately ready for final use.

According to a further aspect of the present invention, therefore, there is provided a method as described in said co-pending application, wherein the explosive is wholly or mostly constituted by a multiple salt of a hypophosphite. Thus, the multiple salt is preferably formed continuously with its utilisation, and/or at an output rate substantially matched with the rate at which it is further utilised and/or in small quantities appropriate to individual explosive devices. The formation of the salt is preferably at least completed in situ in a device, and may be effected wholly in situ. In particular, the multiple salt may be formed in a case of a rimfire cartridge or detonator, or in a cap for a shotgun cartridge.

DESCRIPTION OF THE PREFERRED EMBODIMENTS

By way of example, priming techniques in accordance with the invention will now be described in greater detail. The techniques are intended for the priming of rimfire cartridges.

The materials used to form the priming composition are as follows (percentages are by weight):

| | | |
|---|---|---|
| Lead nitrate | 40% | WET |
| Gum Arabic | — | |
| Lissapol | — | |
| Lead hypophosphite | 40% | DRY |
| Grit | 20% | |

The last two components are relatively insoluble in water, and are provided in the rimfire case in the form of mixed powder. A concentrated aqueous solution of lead nitrate, incorporating small proportions of gum and Lissapol is then added to the powder in a predetermined dosage. The double salt lead nitrato-hypophosphite will separate from the solution at ambient temperature. The product can then be dried until it is in a mouldable form, whereupon the case can be passed to a conventional spinning punch to compact the composition into the rim. The Lissapol functions as a surfactant in this example, but may be found unnecessary.

Drying may be effected at temperatures up to at least 100° C., to produce a product containing approximately 10 to 12% water, which will be suitable for compaction. The product may then be dried completely. If preferred, the initial product can be dried completely, and a predetermined dosage of water added to produce the mouldable composition. A further drying step is needed after compaction as in the alternative process.

In an alternative method of forming a priming composition, the lead nitrate, lead hypophosphite and grit are mixed as dry powders, and a predetermined quantity of dry powder is inserted in the rimfire case. About 10 to 12% by weight of water, together with the Gum Arabic and Lissapol, is then added to the mixed powders, and the mixture forms the double salt generally as described above. Since the mixture now includes the required percentage of water to render it mouldable, there is no need for a drying operation before the case is passed to the spinning punch, or other device, for compacting the mixture into the rim of the case. In this method, the powders may be pre-mixed before they are inserted into the case, or they may be inserted independently and the case may then be vibrated to mix the powders therein. It will be noted that neither of the above techniques requires the mixing step proposed in U.S. Pat. No. 2,160,469 to control the double salt crystal size.

It is most convenient to form the composition at ambient temperature, and this has been found satisfactory. However, the method is not to be limited to such temperatures; it may be desired to control the temperature at which the product forms, and possibly to supply heat to raise the temperature above ambient. Temperatures up to 45° C. have already proved satisfactory; higher temperatures may be used, subject to decomposition of the compounds.

It has also been found possible to form the multiple salt with a pH value in the region 1 to 3, although this is believed more acid than is necessary. Undue acidity is undesirable because of the possibility of an attack upon the material of the case by the solutions therein. On the other hand, undue alkalinity of the solutions may cause stress corrosion of the case. A pH of 3 to 5 is believed suitable. The pH will usually be determined by the pH of the lead nitrate component.

The molecular weights of lead nitrate and lead hypophosphite are approximately the same; the powders are therefore preferably used in approximately equal weight proportions. However, an excess of up to 100% of either component has been found to produce a product having satisfactory sensitivity and initiating power. As the excess of either product increases, however, adequate mixing of the components becomes a problem, and "patches" of unreacted component may be found in the case rim.

Where a solution of lead nitrate is to be added to lead hypophosphite powder, it is desirable to make the solution as concentrated as possible, to minimise the amount of water to be driven off before compaction.

A series of rimfire cartridges primed with lead nitrato-hypophosphite produced by the first method outlined above has been subjected to a series of tests, the results of which are summarised in the following paragraphs:

Sensitivity

This was tested in the conventional manner by dropping a 2 oz ball to cause a striker to indent the case. The "mean" height, that is the height of the ball above the case required to give a 50% chance of firing a cartridge, was found to be $4.71 \pm 1.18$ inches. The "all fire" height was found to be 9 inches. This indicates a sensitivity greater than that of conventional priming compositions comprising lead styphnate and tetrazene.

The sensitivity was found to depend on the proportion of the frictionator, i.e. grit in the example quoted above. If the frictionator was not provided, it was found that the product would not fire even in a gun breech. Alternative frictionators comprise powdered glass and carbon particles (coke). The sensitivity was also found to be dependent to a certain extent upon the proportions of the lead nitrate and lead hypophosphite, slightly lower sensitivity being found with an excess of hypophosphite.

Barrel time

This is the time between the fall of the striker of the gun and the emergence of the bullet from the barrel. The time was measured at $2.59 \pm 0.13$ milliseconds. The range of measurements was 0.58 millisecond. This is satisfactory in comparison with the conventional priming compositions mentioned above.

The barrel time will be dependent to some extent upon the relative proportions of the priming composition and the propellant. In the tests mentioned above, the propellant was the disc-type single base propellant sold by ICI Limited under the name "Acurex". In the tests the cartridges contained about 80 mg of propellant, and the quantity of priming composition was about 20 mg in each case. This is within the range of quantities of conventional priming composition.

Pressure and Velocity

The driving pressure produced by the tested cartridges averaged 5.78 tons/sq. in., giving a velocity of approximately 1056 feet/second. This is slightly lower than the pressure and velocity found with conventional priming compositions, but is satisfactory. After storage in humid conditions, the cartridges were found to give a pressure of about 5.68 tons/sq. in. and a velocity of 1038 feet/second.

Mass explosibility

This is the percentage of cases initiated by an explosion of one case in a group. It was found that 90+% of the group could be initiated in this manner, possibly because of the very high sensitivity of the priming composition. This may be dealt with to some extent by using additives, such as glass "flour" and other inert substances (see U.S. Pat. No. 2,356,210) or polyvinyl alcohol (see U.S. Pat. No. 2,341,262), or by adding a layer of varnish over the priming composition in the primed cases. An alternative method of dealing with the problem would be to produce cartridges in a continuous line, avoiding groups of primed cases at any point along the line.

The invention is not limited to details of the examples given above. Firstly, the invention may be used to prime detonators as well as rimfire cartridges. Further, the invention is not limited to use with the disc-type powder referred to above, but may be used with any of the modern nitrocellulose based powders.

The priming composition may include further additives to give additional properties or modify the properties of the composition. For example, additives may be included to reduce mass explosibility as referred to above, or to improve workability as described in U.S. Pat. No. 2,327,867, No. 2,377,670 and No. 2,662,818. Other additives may provide fuel: for example, antimony sulphidemay be included for this purpose and results in a bigger flame. Silicon and calcium silicide both give sparks. Fuels may be particularly important in priming of caps. The double salt lead nitrato-hypophosphite can be formed in the presence of each of the fuels referred to, and it has been found that each of these fuels tends to increase sensitivity of the composition, reducing the proportion of frictionator required. The composition may also include small proportions of other primary explosives, if required.

In the method of producing the multiple salt, it is not necessary to perform the operation wholly within the utilising device, that is the rimfire case, cap or the detonator case. The components may be brought together outside the device, formation being completed in situ. Alternatively, the formation may also be completed outside the device, and the formed product may be charged into the device. It is preferred to produce the multiple salt in small quantities, preferably appropriate to individual explosive devices, because of its high sensitivity and the explosion risk associated with a large batch. However, in its broadest scope, the invention is not limited to production in small quantities.

The invention is not limited to the double salt lead nitrato-hypophosphite. Other multiple salts may also be used, for example those referred to in U.S. Pat. No. 2,175,826, No. 2,292,956 and No. 2,352,964.

The invention of course extends to an explosive device incorporating a priming composition, as defined above, or made by a method as defined above.

It will be noted that in a method as defined above, the multiple salt is permitted to crystallise substantially freely, that is without precautions to control crystal size as described in U.S. Pat. No. 2,160,469. The formation of "extended crystals" referred to in that patent can be permitted in situ in a utilising device. In particular, the invention extends to an explosive device incorporating a priming composition whereof the primary explosive is wholly or mostly constituted by a multiple salt of a hypophosphite, particularly but not exclusively lead nitrato-hypophosphite, which has been permitted to crystallise freely during its formation.

Any priming composition including lead nitrato-hypophosphite may be found sensitive to moisture under humid storage conditions. This problem can be dealt with for rimfire cartridges by applying a layer of sealing material, preferably a bituminous material, around the junction of the case and bullet. A suitable sealing material is "Ritolastic" sold by Lancashire Tar Distillers Building Products of Church Road, Litherland, Liverpool, Lancashire, England.

We have also found that it is possible to reduce the quantity of priming composition required to initiate propellant charges in rimfire cartridges when lead nitrato-hypophosphite is used. For example, for an 80 mg charge of propellant, a priming charge in the region of 14 mg has been found satisfactory.

We have established that it is not essential to mix the components of lead nitrato-hypophosphite to obtain a satisfactory product, although mixing will give added assurance of a uniform product in large scale production of explosive devices. It appears that a solution containing at least one component can diffuse through a body of undissolved material to produce the double salt. Since only small quantities of material are involved in the preferred embodiment the degree of diffusion is usually sufficient to give the required result.

The invention does not require the use of multiple salts alone as primary explosives. Other explosives e.g. styphnates may be included, and may be formed in situ simultaneously with the multiple salt.

The present invention contrasts with the disclosure in German Patent Specification No. 289016 in that it can employ the explosive in the form of a mass of interlocked crystals or particles. This aids retention of the explosive in a device. The German specification refers only to the "pure crystalline" form of lead nitrato-hypophosphite in priming of explosive devices. We believe this to be a reference to a "free flowing" crystal form, which we do not require. The German specification only suggests the freely crystallised product for use in fog signals.

We claim:

1. A priming composition for an explosive device including a primary explosive which is produced in situ in relation to at least one other element by bringing together components to form a combination including a multiple salt of a hypophosphite which has been permitted to crystallize freely in situ during its formation.

2. A composition as claimed in claim 1 wherein the multiple salt is lead nitrato-hypophospite.

3. A device including a priming composition as claimed in claim 1.

4. A method of producing an explosive for use in priming manufactured explosive devices wherein said explosive is produced in situ in a utilising service by bringing together of components to form a multiple salt of a hypophosphite.

5. A method as claimed in claim 4 wherein said explosive is produced in a mixture of other ingredients of a priming composition.

6. A method as claimed in claim 4 wherein said explosive is produced continuously with its further utilisation.

7. A method as claimed in claim 4 wherein each of said quantities is of a size appropriate to an invididual utilisation demand.

8. A method as claimed in claim 7 wherein each of said quantities comprises a mixture of ingredients of a priming composition.

9. A method as claimed in claim 7 wherein said explosive is produced continuously with its further utilisation.

10. A method as claimed in claim 7 wherein each of said quantities comprises a mixture of a priming composition.

11. A device comprising explosive made by a method as claimed in claim 4.

* * * * *